US009240144B2

(12) United States Patent
Cho et al.

(10) Patent No.: US 9,240,144 B2
(45) Date of Patent: Jan. 19, 2016

(54) LIQUID CRYSTAL DISPLAY AND LOCAL DIMMING CONTROL METHOD THEREOF

(71) Applicant: LG DISPLAY CO., LTD., Seoul (KR)

(72) Inventors: Byoungchul Cho, Seoul (KR); Kyungjoon Kwon, Seoul (KR); Heewon Ahn, Goyang-si (KR); Changkyun Park, Incheon (KR)

(73) Assignee: LG DISPLAY CO., LTD., Seoul (KR)

( * ) Notice: Subject to any disclaimer, the term of this patent is extended or adjusted under 35 U.S.C. 154(b) by 358 days.

(21) Appl. No.: 13/849,212

(22) Filed: Mar. 22, 2013

(65) Prior Publication Data

US 2013/0215161 A1 Aug. 22, 2013

Related U.S. Application Data

(62) Division of application No. 12/769,982, filed on Apr. 29, 2010, now Pat. No. 8,427,418.

(30) Foreign Application Priority Data

Nov. 30, 2009 (KR) ..... 10-2009-0116808

(51) Int. Cl.
*G09G 5/02* (2006.01)
*G09G 3/34* (2006.01)

(52) U.S. Cl.
CPC ..... *G09G 3/3406* (2013.01); *G09G 3/3426* (2013.01); *G09G 2320/0233* (2013.01); *G09G 2320/064* (2013.01); *G09G 2320/0646* (2013.01); *G09G 2360/16* (2013.01)

(58) Field of Classification Search
USPC ..... 345/694, 102
See application file for complete search history.

(56) References Cited

U.S. PATENT DOCUMENTS

2010/0079476 A1* 4/2010 Baba et al. ..... 345/589
2010/0231573 A1* 9/2010 Adachi ..... 345/211

FOREIGN PATENT DOCUMENTS

CN 101303839 A 11/2008
JP 2009139931 A 6/2009
KR 20080062291 A 7/2008
TW 200809757 A 2/2008
WO WO 2009063874 A1 * 5/2009 ..... G09G 3/34

OTHER PUBLICATIONS

Office Action issued in corresponding Taiwan Patent Application No. 099117654, mailed Oct. 9, 2013, 12 pages.
Office Action issued in corresponding Korean Patent Application No. 10-2009-0116808, mailed Nov. 19, 2012.
Office Action issued in corresponding Chinese Patent Application No. 201010167300.0, mailed May 13, 2013, 7 pages.

* cited by examiner

*Primary Examiner* — Kwang-Su Yang
(74) *Attorney, Agent, or Firm* — Brinks Gilson & Lione

(57) ABSTRACT

A liquid crystal display includes a liquid crystal display panel, a backlight unit including a plurality of light sources, the backlight unit providing light to a back surface of the liquid crystal display panel, a backlight driving circuit that individually drives a plurality of previously determined blocks each including the light sources based on a dimming value of each of the blocks, and a local dimming control circuit that calculates a pixel gain value compensating for a luminance reduction resulting from the dimming value of each block and corrects the pixel gain value based on a gray-scale saturation level of each block.

6 Claims, 7 Drawing Sheets

| | | | | | |
|---|---|---|---|---|---|
| BLK[1, 1] | BLK[1, 2] | BLK[1, 3] | BLK[1, 4] | · · · · | BLK[1, m] |
| BLK[2, 1] | | | | | |
| BLK[3, 1] | | | | | |
| ⋮ | | ⋮ | | · · · · | |
| BLK[n, 1] | | | | | BLK[n, m] |

LIQUID CRYSTAL DISPLAY AND LOCAL DIMMING CONTROL METHOD THEREOF

The present patent document is a divisional of U.S. patent application Ser. No. 12/769,982 filed Apr. 29, 2010, which claims priority to Korean Patent Application No. 10-2009-0116808 filed in Korea on Nov. 30, 2009, which is hereby incorporated by reference.

BACKGROUND

1. Field of the Invention

Embodiments of the disclosure relate to a liquid crystal display and a local dimming control method thereof capable of improving image quality.

2. Discussion of the Related Art

The range of applications for liquid crystal displays has gradually widened because of their excellent characteristics such as light weight, thin profile, and low power consumption. Liquid crystal displays have been used in personal computers such as notebook PCs, office automation equipments, audio/video equipments, interior/outdoor advertising display devices, and the like. The liquid crystal displays display an image using a thin film transistor (TFT) as a switching element. A backlit liquid crystal display occupying most of the liquid crystal displays controls an electric field applied to a liquid crystal layer and modulates light coming from a backlight unit, thereby displaying an image.

The image quality of the liquid crystal display depends on its contrast characteristic. Improvements to the contrast characteristic are limited using only a method for controlling the data voltage applied to the liquid crystal layer and modulating a light transmittance of the liquid crystal layer. As a solution, a backlight dimming method has been proposed so as to improve the contrast characteristic. The backlight dimming method adjusts the luminance of a backlight unit depending on an image displayed on the liquid crystal display. The backlight dimming method includes a global dimming method for adjusting a luminance of the entire display surface of the liquid crystal display and a local dimming method for locally controlling a luminance of the display surface of the liquid crystal display. The global dimming method can improve a dynamic contrast ratio measured between two adjacent frames. The local dimming method can locally control the luminance of the display surface of the liquid crystal display within one frame period, thereby improving a static contrast ratio which is difficult to improve using the global dimming method.

In the local dimming method, the backlight unit is divided into a plurality of blocks. The local dimming method adjusts a dimming value of each of the plurality of blocks, thereby increasing a luminance of the backlight unit belonging to the block displaying a bright image and reducing a luminance of the backlight unit belonging to the block displaying a dark image. In other words, a plurality of light sources of the backlight unit are partially turned on in local dimming. Thus, the luminance of the backlight unit when the local dimming method is applied is less than the luminance of the backlight unit when the local dimming method is not applied (i.e., when all of the light sources of the backlight unit are turned on). A modulation of pixel data may compensate for a deficiency of the luminance of the backlight unit resulting from the local dimming method. The modulation of the pixel data is performed based on a pixel gain value according to the result of an analysis of an amount of light of the backlight unit of each block.

The pixel gain value is determined based on data required to allow a luminance obtained from a total amount of light (i.e., an amount of light in dimming) reaching a corresponding pixel in the local dimming using a dimming value of a block including the corresponding pixel to be equal to a luminance obtained from a total amount of light (i.e., an amount of light in non-dimming) reaching the corresponding pixel in non-local dimming. The pixel gain value is calculated by a ratio of the amount of light in the non-dimming to the amount of light in the dimming. When the amount of light in the dimming is less than the amount of light in the non-dimming, the pixel gain value in the corresponding pixel increases. As the pixel gain value increases, an upward modulation width of the data increases. As a result, grayscale saturation occurs in which high gray levels appear at the same brightness. As the grayscale saturation becomes serious, the image quality of the liquid crystal display is degraded. Accordingly, a method for controlling the pixel gain value based on a grayscale saturation level is required.

BRIEF SUMMARY

In one aspect, there is disclosed a liquid crystal display comprising a liquid crystal display panel, a backlight unit including a plurality of light sources, the backlight unit providing light to a back surface of the liquid crystal display panel, a backlight driving circuit that individually drives a plurality of previously determined blocks each including the light sources based on a dimming value of each of the blocks, and a local dimming control circuit that calculates a pixel gain value compensating for a luminance reduction resulting from the dimming value of each block and corrects the pixel gain value based on a grayscale saturation level of each block.

In another aspect, there is disclosed a local dimming control method of a liquid crystal display including a liquid crystal display panel and a plurality of light sources providing light to a back surface of the liquid crystal display panel, the local dimming control method comprising individually driving a plurality of previously determined blocks each including the light sources based on a dimming value of each of the blocks, and calculating a pixel gain value compensating for a luminance reduction resulting from the dimming value of each block and correcting the pixel gain value based on a grayscale saturation level of each block.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE DRAWINGS AND THE PRESENTLY PREFERRED EMBODIMENTS

Reference will now be made in detail embodiments of the invention examples of which are illustrated in the accompanying drawings.

Figure 1:
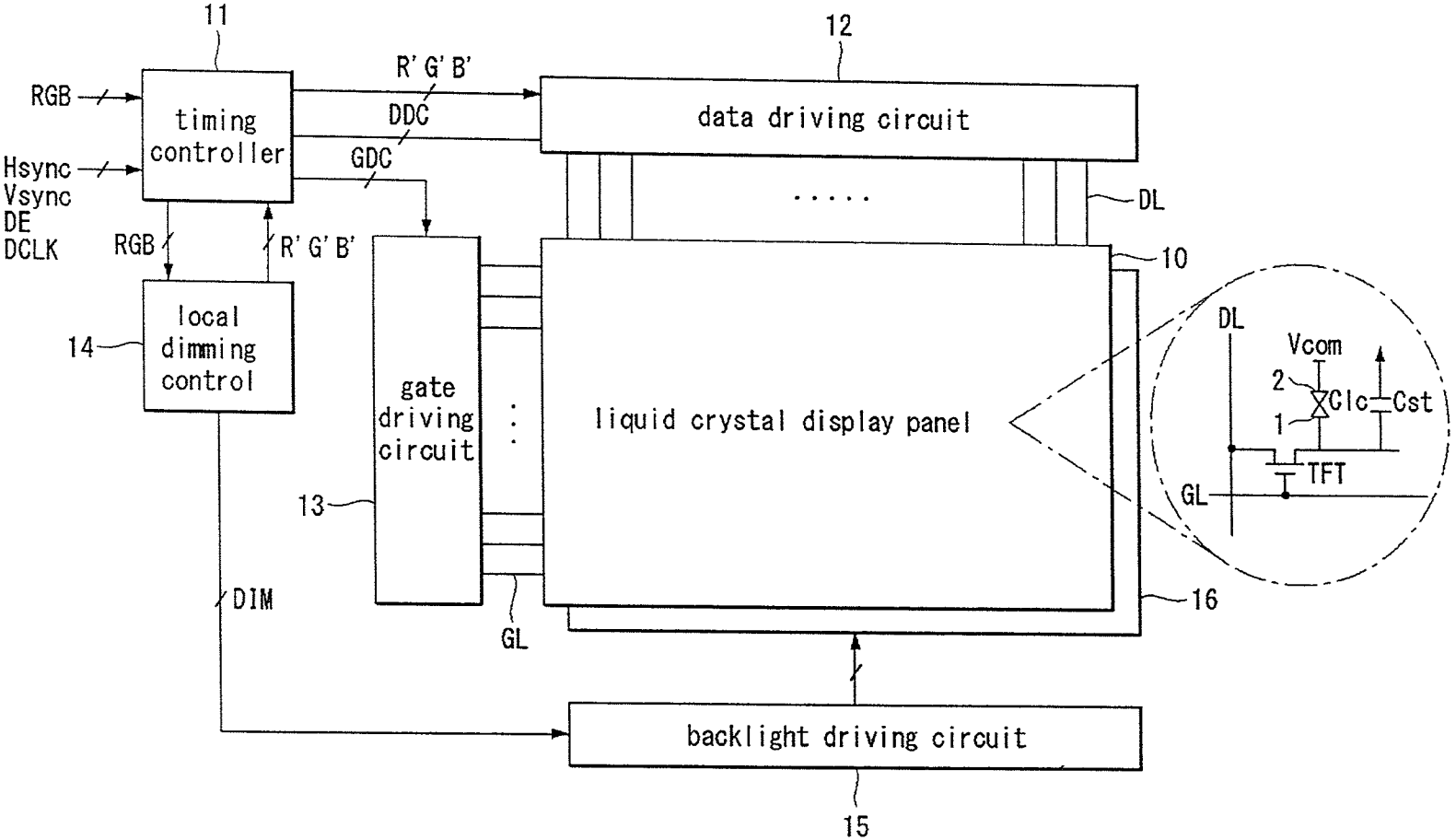
FIG. 1 illustrates a liquid crystal display according to an exemplary embodiment of the invention.

FIG. 1 illustrates a liquid crystal display according to an exemplary embodiment of the invention. As shown in FIG. 1, a liquid crystal display according to an exemplary embodiment of the invention includes a liquid crystal display panel 10, a timing controller 11, a data driving circuit 12, a gate driving circuit 13, a local dimming control circuit 14, a backlight driving circuit 15, and a backlight unit 16.

The liquid crystal display panel 10 includes an upper glass substrate, a lower glass substrate, and a liquid crystal layer between the upper and lower glass substrates. A plurality of data lines DL and a plurality of gate lines GL cross one another on the lower glass substrate of the liquid crystal display panel 10. A plurality of liquid crystal cells Clc are arranged on the liquid crystal display panel 10 in a matrix form in accordance with a crossing structure of the data lines DL and the gate lines GL. Each of the plurality of liquid crystal cells Clc includes a thin film transistor TFT, a pixel electrode 1 connected to the thin film transistor TFT, a storage capacitor Cst, and the like.

A black matrix, a color filter, and a common electrode 2 are formed on the upper glass substrate of the liquid crystal display panel 10. In a vertical electric field driving manner such as a twisted nematic (TN) mode and a vertical alignment (VA) mode, the common electrode 2 is formed on the upper glass substrate. In a horizontal electric field driving manner such as an in-plane switching (IPS) mode and a fringe field switching (FFS) mode, the common electrode 2 is formed on the lower glass substrate along with the pixel electrode 1. The plurality of liquid crystal cells Clc include red (R) liquid crystal cells for displaying a red image, green (G) liquid crystal cells for displaying a green image, and blue (B) liquid crystal cells for displaying a blue image. The R, G, and B liquid crystal cells form a unit pixel. Polarizing plates are respectively attached to the upper and lower glass substrates of the liquid crystal display panel 10. Alignment layers for setting a pre-tilt angle of liquid crystals are respectively formed on the inner surfaces contacting the liquid crystals in the upper and lower glass substrates.

The timing controller 11 supplies digital video data RGB received from a system board, on which an external video source is mounted, to the local dimming control circuit 14 and supplies a modulation data R'G'B' modulated by the local dimming control circuit 14 to the data driving circuit 12. The timing controller 11 receives timing signals Vsync, Hsync, DE, and DCLK from the system board to generate a data timing control signal DDC and a gate timing control signal GDC for respectively controlling operation timings of the data driving circuit 12 and the gate driving circuit 13 based on the timing signals Vsync, Hsync, DE, and DCLK. The timing controller 11 inserts an interpolation frame between frames of a signal of an input image input at a frame frequency of 60 Hz and multiplies the frequency of the data timing control signal DDC by the frequency of the gate timing control signal GDC. Hence, the timing controller 11 can control operations of the data driving unit 12 and the gate driving unit 13 at a frame frequency of (60×N) Hz, where N is a positive integer equal to or greater than 2.

The data driving circuit 12 includes a plurality of data driver integrated circuits (ICs). Each of the data driver ICs includes a shift register for sampling a clock, a register for temporarily storing the digital video data RGB, a latch that stores data corresponding to one line in response to the clock received from the shift register and simultaneously outputs the data each corresponding to one line, a digital-to-analog converter (DAC) for selecting positive and negative gamma voltages based on a gamma reference voltage corresponding to the digital data received from the latch, a multiplexer for selecting the data line DL receiving analog data converted from the positive and negative gamma voltages, an output buffer connected between the multiplexer and the data lines DL, and the like. The data driving circuit 12 latches the modulation data R'G'B' under the control of the timing controller 11 and converts the latched modulation data R'G'B' into positive and negative analog data voltages using positive and negative gamma compensation voltages. The data driving circuit 12 then supplies the positive and negative analog data voltages to the data lines DL.

The gate driving circuit 13 includes a plurality of gate driver ICs. Each of the gate driver ICs includes a shift register, a level shifter for converting an output signal of the shift register into a swing width suitable for a TFT drive of the liquid crystal cells, an output buffer, and the like. The gate driving circuit 13 sequentially outputs a gate pulse (or a scan pulse) under the control of the timing controller 11 and supplies the gate pulse to the gate lines GL. Hence, a horizontal line to receive the data voltage is selected.

The local dimming control circuit 14 analyzes the digital video data RGB received from the timing controller 11 to calculate a representative value of each of a plurality of block. The local dimming control circuit 14 determines a dimming value DIM of each block for controlling a plurality of light sources of the backlight unit 16 based on the representative value of each block. The local dimming control circuit 14 calculates a pixel gain value compensating for a luminance reduction resulting from the dimming value DIM of each block and then compensates for the digital video data RGB based on the pixel gain value. The local dimming control circuit 14 analyzes the compensated data to calculate a grayscale saturation level. The local dimming control circuit 14 adjusts an amount of light in non-dimming or adjusts the dimming value DIM of each block (i.e., adjusts an amount of light in dimming), so that an estimate value of the grayscale saturation level converges to a previously determined target value. Hence, the local dimming control circuit 14 corrects the pixel gain value, and compensates the digital video data RGB using the corrected pixel gain value, and outputs the compensated data as the modulation data R'G'B'.

The backlight driving circuit 15 drives the light sources belonging to each block using a pulse width modulation (PWM) signal having a varying duty ratio based on the dimming value DIM of each block received from the local dimming control circuit 14. In other words, the backlight driving circuit 15 individually drives the plurality of blocks each including the light sources. Turn-on times and turn-off times of the light sources are controlled based on the duty ratio of the PWM signal.

The backlight unit 16 includes the plurality of light sources divided the plurality of blocks in a matrix form and provides light to the liquid crystal display panel 10. The backlight unit 16 may be one of an edge type backlight unit and a direct type backlight unit. In the direct type backlight unit 16, a plurality of optical sheets and a diffusion plate are stacked under the liquid crystal display panel 10 and the plurality of light sources are positioned under the diffusion plate. In the edge type backlight unit 16, a plurality of optical sheets and a light guide plate are stacked under the liquid crystal display panel 10 and the plurality of light sources are positioned at the sides of the light guide plate. The plurality of light sources of the backlight unit 16 may be a point light source such as a light emitting diode (LED).

Figures 2, 3:
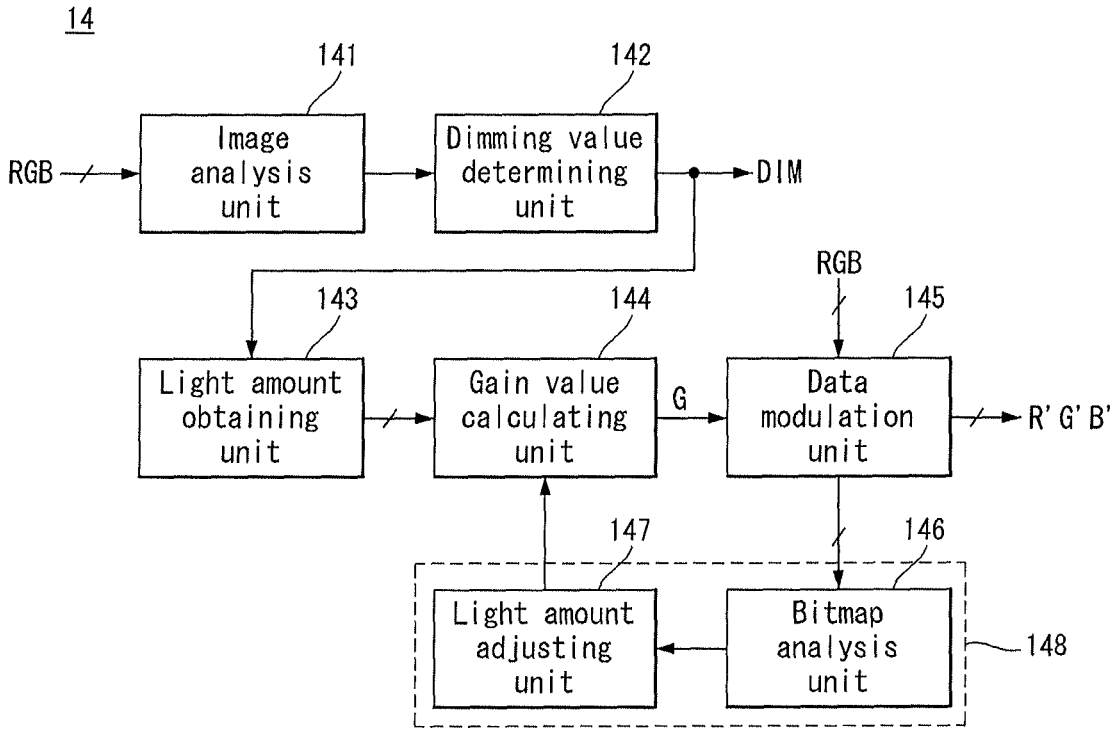
FIG. 2 illustrates an exemplary configuration of a local dimming control circuit.
FIG. 3 illustrates an example of dividing a surface light source into blocks for achieving local dimming.

FIG. 2 illustrates an exemplary configuration of the local dimming control circuit 14 capable of correcting the pixel gain value based on the grayscale saturation level. The local dimming control circuit 14 shown in FIG. 2 adjusts an amount of light in the non-dimming based on the grayscale saturation level to correct the pixel gain value.

As shown in FIG. 2, the local dimming control circuit 14 includes an image analysis unit 141, a dimming value determining unit 142, a light amount obtaining unit 143, a gain value calculating unit 144, a data modulation unit 145, a bitmap analysis unit 146, and a light amount adjusting unit 147.

As shown in FIG. 3, the image analysis unit 141 analyzes the digital video data RGB in each of a plurality of imaginary blocks BLK[1,1] to BLK[n,m] divided from a display surface of the liquid crystal display panel 10 in a matrix form to obtain a representative value of each of the blocks BLK[1,1] to BLK[n,m]. More specifically, the image analysis unit 141 obtains a maximum gray value from the digital video data RGB of each of pixels included in each block and divides a sum of maximum gray values of the pixels of each block by the number of pixels included in each block, thereby obtaining the representative value of each block.

The dimming value determining unit 142 maps the representative value of each block received from the image analysis unit 141 to a previously determined dimming curve and determines the dimming value DIM of each block. The dimming curve may be implemented as a lookup table. The dimming value DIM of each block may be proportional to the representative value of each block.

Figure 4:
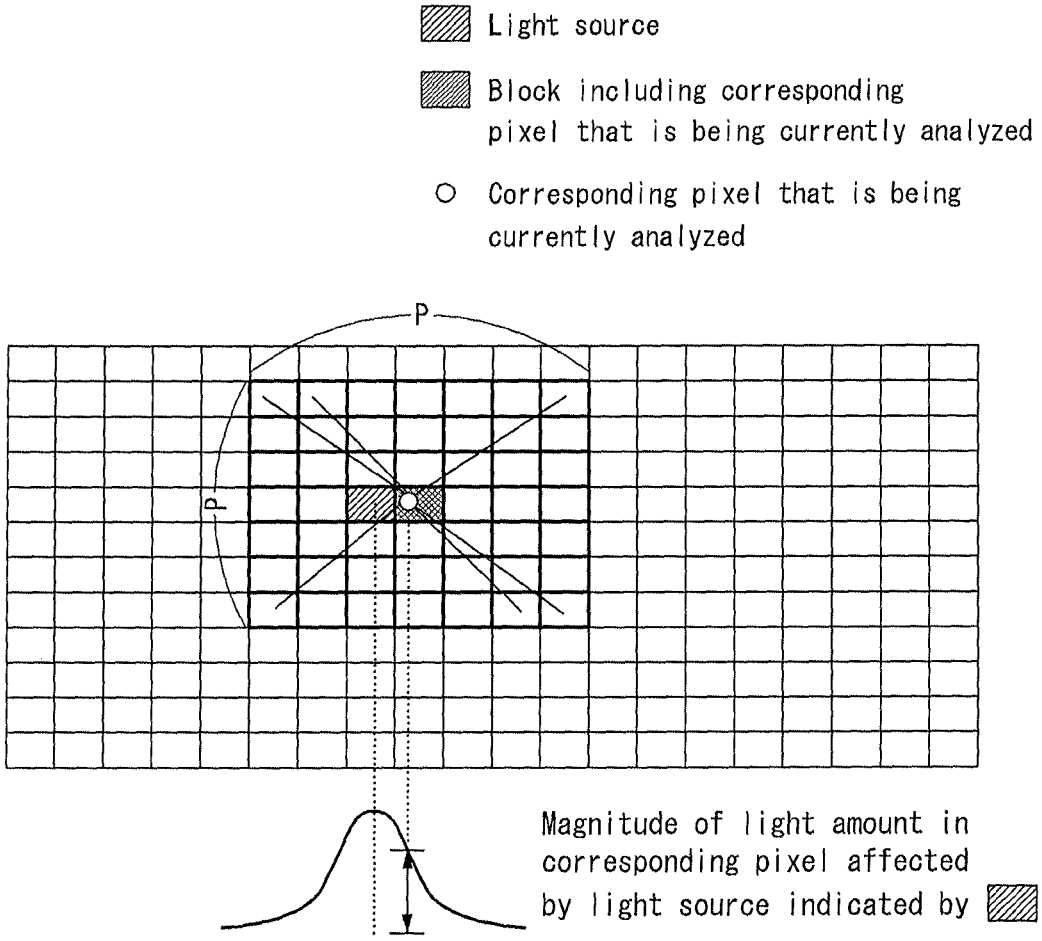
FIG. 4 illustrates an analysis area of size P×P surrounding a block including a corresponding pixel, where P is the number of blocks.

The light amount obtaining unit 143 obtains an amount of light (i.e., the amount of light in the non-dimming) reaching each pixel in non-local dimming and an amount of light (i.e., the amount of light in the dimming) reaching each pixel in the local dimming using the dimming value DIM of each block. The amount of light in the non-dimming indicates a total amount of light reaching a corresponding pixel when all of light sources of the backlight unit 16 are turned on at a constant brightness. As shown in FIG. 4, the amount of light in the dimming indicates a total amount of light reaching a corresponding pixel in an analysis area of size P×P surrounding a block including the corresponding pixel in the local dimming in a state where the block is positioned in the middle of the analysis area, where P indicates the number of blocks and is an odd number equal to or greater than 3. In other words, the amount of light in the dimming is determined by the dimming values DIM of the blocks positioned inside the analysis area.

The gain value calculating unit 144 calculates a pixel gain value G of each pixel based on the amount of light in the non-dimming and the amount of light in the dimming received from the light amount obtaining unit 143. More specifically, the gain value calculating unit 144 divides the amount of light in the non-dimming by the amount of light in the dimming and performs an exponential operation of $1/\gamma$ on the division result, thereby calculating the pixel gain value G.

The data modulation unit 145 multiplies the digital video data RGB by the pixel gain value G received form the gain value calculating unit 144 to modulate the digital video data RGB. Hence, the data modulation unit 145 compensates for the digital video data RGB.

The bitmap analysis unit 146 analyzes the compensated data corresponding to one frame in a bitmap manner to calculate the grayscale saturation level. The bitmap analysis unit 146 then generates an estimate value of the grayscale saturation level. In the bitmap manner, the compensated data corresponding to one frame is sequentially scanned while moving an analysis mask of size k×k from side to side or up and down at an interval of one pixel, where k indicates the number of pixels and is a positive integer. Compensated data of a maximum gray level is substituted by "1", and all of compensated data other than the compensated data of the maximum gray level is substituted by "0". The bitmap analysis unit 146 counts the number of "1". The bitmap analysis unit 146 increases the estimate value of the grayscale saturation level when a count value (i.e., the number of "1") increases and reduces the estimate value of the grayscale saturation level when the count value decreases. The grayscale saturation level when the estimate value is a large value is greater than the grayscale saturation level when the estimate value is a small value.

The light amount adjusting unit 147 adjusts the amount of light in the non-dimming based on the estimate value received from the bitmap analysis unit 146 and performs a feedback to the gain value calculating unit 144. When the estimate value is greater than a previously determined target value, the light amount adjusting unit 147 reduces the amount of light in the non-dimming. On the contrary, when the estimate value is less than the target value, the light amount adjusting unit 147 increases the amount of light in the non-dimming, thereby converging the estimate value to the target value. The target value may be selected as a proper value capable of reducing the grayscale saturation while reducing power consumption. The gain value calculating unit 144 corrects the pixel gain value G by an adjusted amount of the amount of light in the non-dimming and supplies the corrected pixel gain value G to the data modulation unit 145. The data modulation unit 145 multiply the digital video data RGB by the corrected pixel gain value G obtained when the estimate value is equal to the target value, thereby outputting the modulation data R'G'B'.

The bitmap analysis unit 146 and the light amount adjusting unit 147 may be integrated into a gain value correcting unit 148.

Figure 5:
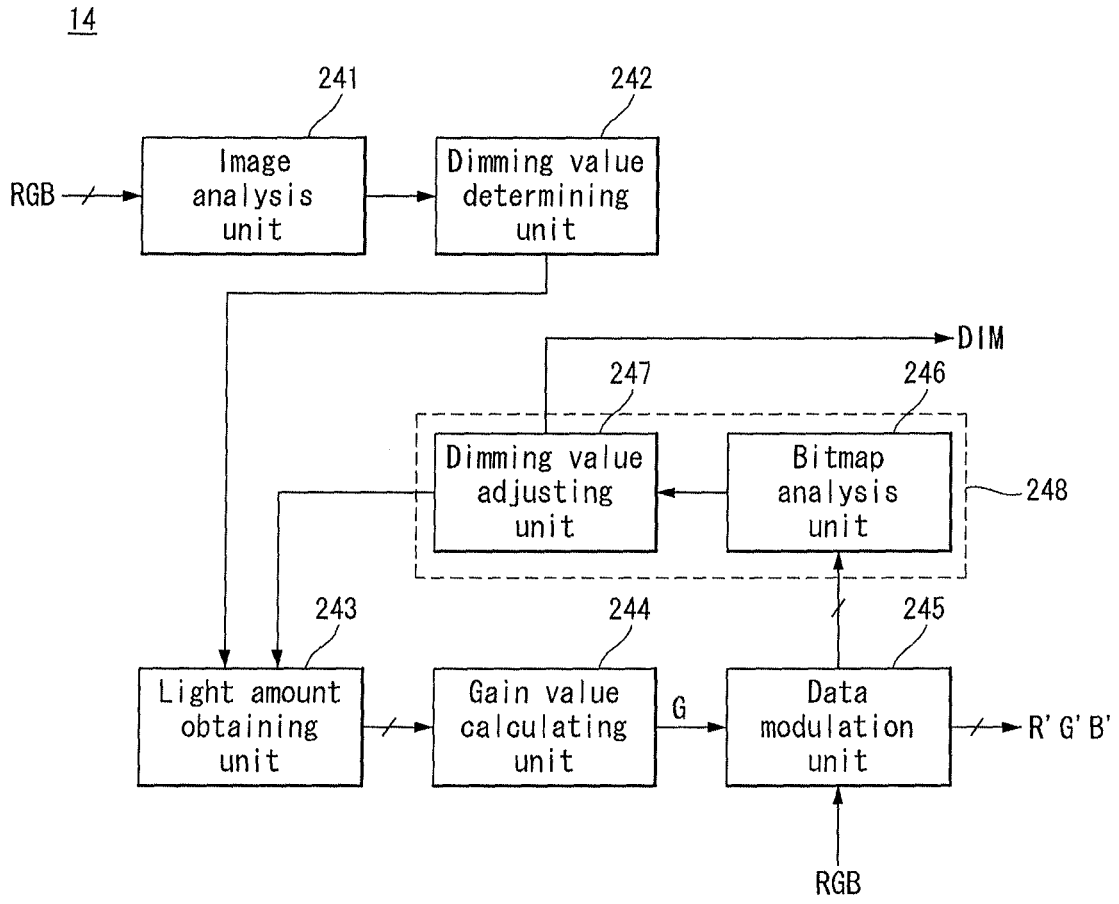
FIG. 5 illustrates another exemplary configuration of a local dimming control circuit.

FIG. 5 illustrates another exemplary configuration of the local dimming control circuit 14 capable of correcting the pixel gain value based on the grayscale saturation level. The local dimming control circuit 14 shown in FIG. 5 adjusts the dimming value DIM of each block (i.e., an amount of light in the dimming) based on the grayscale saturation level to correct the pixel gain value.

As shown in FIG. 5, the local dimming control circuit 14 includes an image analysis unit 241, a dimming value determining unit 242, a light amount obtaining unit 243, a gain value calculating unit 244, a data modulation unit 245, a bitmap analysis unit 146, and a dimming value adjusting unit 247.

The image analysis unit 241 analyzes the digital video data RGB in each of a plurality of imaginary blocks BLK[1,1] to BLK[n,m] (refer to FIG. 3) divided from a display surface of the liquid crystal display panel 10 in a matrix form to obtain a representative value of each of the blocks BLK[1,1] to BLK[n,m]. More specifically, the image analysis unit 241 obtains a maximum gray value among the digital video data RGB of each pixel in each block and divides a sum of maximum gray values of the pixels of each block by the number of pixels included in each block, thereby obtaining the representative value of each block.

The dimming value determining unit 242 maps the representative value of each block received from the image analysis unit 241 to a previously determined dimming curve to determine the dimming value DIM of each block. The dimming curve may be implemented as a lookup table. The dimming value DIM of each block may be proportional to the representative value of each block.

The light amount obtaining unit 243 obtains an amount of light (i.e., the amount of light in the non-dimming) reaching each pixel in the non-local dimming and an amount of light (i.e., the amount of light in the dimming) reaching each pixel in the local dimming using the dimming value DIM of each block. The amount of light in the non-dimming indicates a total amount of light reaching a corresponding pixel when all of light sources of the backlight unit 16 are turned on at a constant brightness, for example, at a maximum brightness. As shown in FIG. 4, the amount of light in the dimming indicates a total amount of light reaching a corresponding pixel in an analysis area of size P×P surrounding a block including the corresponding pixel in the local dimming in a state where the block is positioned in the middle of the analysis area, where P indicates the number of blocks and is an odd number equal to or greater than 3. In other words, the amount of light in the dimming may vary depending on changes in the dimming values DIM of the blocks positioned inside the analysis area.

The gain value calculating unit 244 calculates a pixel gain value G of each pixel based on the amount of light in the non-dimming and the amount of light in the dimming received from the light amount obtaining unit 243. More specifically, the gain value calculating unit 244 divides the amount of light in the non-dimming by the amount of light in the dimming and performs an exponential operation of $1/\gamma$ on the division result, thereby calculating the pixel gain value G.

The data modulation unit 245 multiplies the digital video data RGB by the pixel gain value G received form the gain value calculating unit 244 to modulate the digital video data RGB. Hence, the data modulation unit 245 compensates for the digital video data RGB.

The bitmap analysis unit 246 analyzes the compensated data corresponding to one frame in the bitmap manner to calculate the grayscale saturation level. The bitmap analysis unit 246 then generates an estimate value of the grayscale saturation level. In the bitmap manner, the compensated data corresponding to one frame is sequentially scanned while moving an analysis mask of size k×k from side to side or up or down at an interval of one pixel, where k indicates the number of pixels and is a positive integer. Compensated data of a maximum gray level is substituted by "1", and all of compensated data other than the compensated data of the maximum gray level is substituted by "0". The bitmap analysis unit 246 counts the number of "1". The bitmap analysis unit 246 increases the estimate value of the grayscale saturation level when a count value (i.e., the number of "1") increases and reduces the estimate value of the grayscale saturation level when the count value decreases. The grayscale saturation level when the estimate value is a large value is greater than the grayscale saturation level when the estimate value is a small value.

Figure 6:
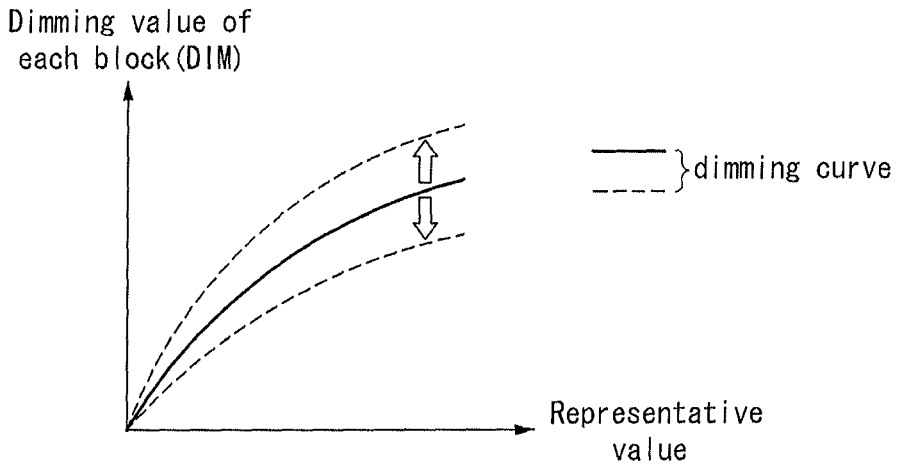
FIG. 6 illustrates an example of controlling a dimming value of each block through a modulation of a dimming curve.

The dimming value adjusting unit 247 adjusts the dimming value DIM of each block based on the estimate value received from the bitmap analysis unit 246 and performs a feedback to the light amount obtaining unit 243. When the estimate value is greater than a previously determined target value, the dimming value adjusting unit 247 moves a dimming curve upward to increase the dimming value DIM of each block as shown in FIG. 6. On the contrary, when the estimate value is less than the target value, the dimming value adjusting unit 247 moves the dimming curve downward to reduce the dimming value DIM of each block as shown in FIG. 6. Hence, the estimate value converges to the target value. The dimming value adjusting unit 247 outputs the dimming value DIM of each block when the estimate value converges to the target value as a final dimming value. The target value may be selected as a proper value capable of reducing the grayscale saturation while reducing power consumption. The light amount obtaining unit 243 varies the amount of light in the dimming based on the adjusted dimming value DIM of each block. The gain value calculating unit 244 corrects the pixel gain value G by an adjusted amount of the amount of light in the dimming and supplies the corrected pixel gain value G to the data modulation unit 245. The data modulation unit 245 multiply the digital video data RGB by the corrected pixel gain value G obtained when the estimate value is equal to the target value, thereby outputting the modulation data R'G'B'.

The bitmap analysis unit 246 and the dimming value adjusting unit 247 may be integrated into a gain value correcting unit 248.

In the exemplary embodiment of the invention, because the grayscale saturation in a high grayscale region to which the local dimming control is applied is further improved compared with a related art to which the local dimming control is not applied, the image quality of the liquid crystal display according to the exemplary embodiment of the invention can be greatly improved.

Figure 7:
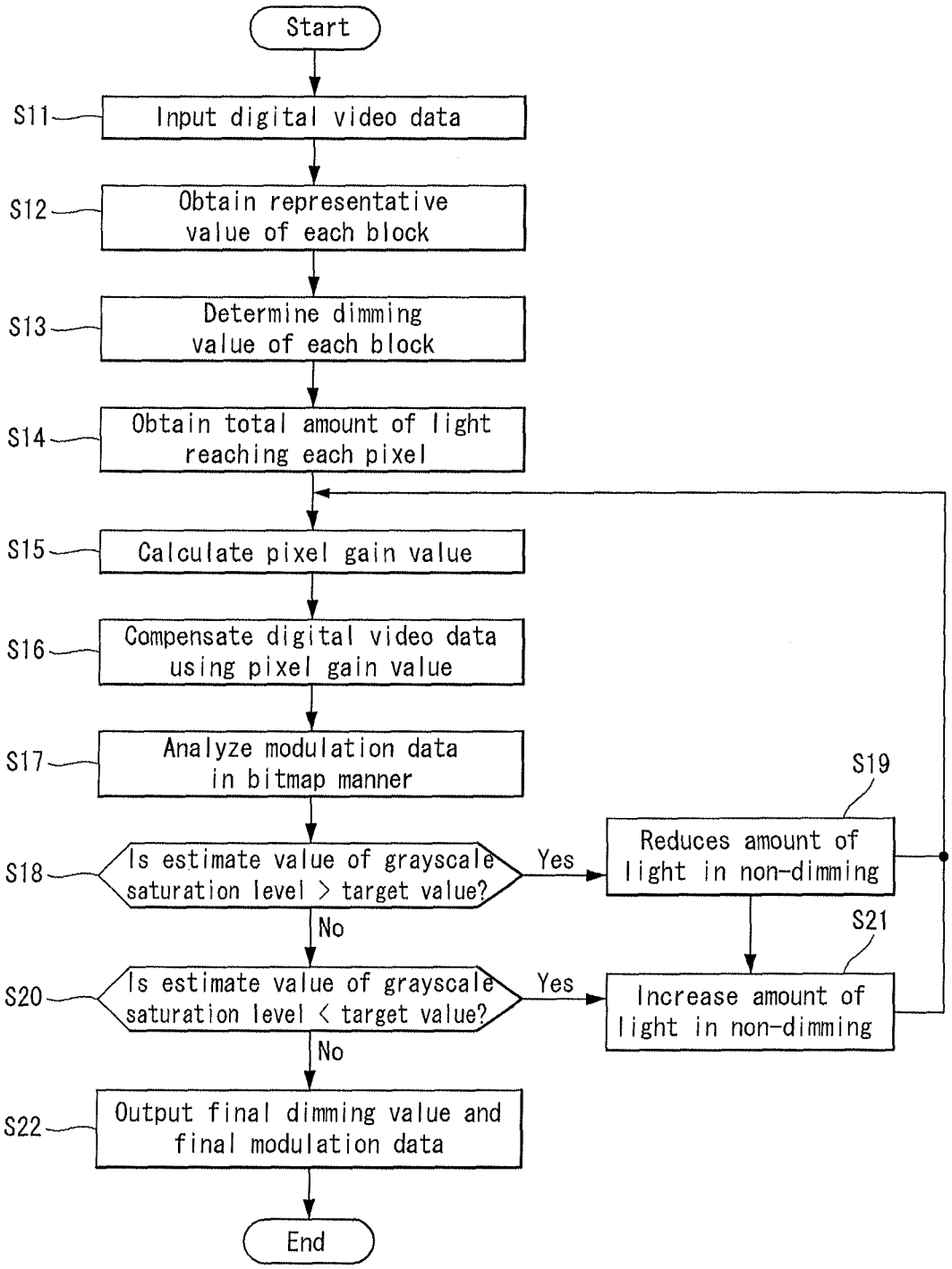
FIG. 7 illustrates an exemplary local dimming control method of a liquid crystal display according to an exemplary embodiment of the invention.

FIG. 7 illustrates an exemplary local dimming control method capable of correcting the pixel gain value based on the grayscale saturation level.

As shown in FIG. 7, the local dimming control method analyzes the input digital video data RGB in each of a plurality of imaginary blocks divided from the display surface of the liquid crystal display panel in a matrix form in step S11 and obtains a representative value of each of the blocks in step S12. Then, the local dimming control method maps the representative value of each block to a previously determined dimming curve to determine a dimming value of each block in step S13.

The local dimming control method obtains an amount of light in the non-dimming and an amount of light in the dimming for each pixel in step S14. The amount of light in the non-dimming indicates a total amount of light reaching a corresponding pixel when all of light sources of the backlight unit are turned on at a constant brightness in the non-local dimming. The amount of light in the dimming indicates a total amount of light reaching a corresponding pixel in an analysis area of size P×P surrounding a block including the corresponding pixel in the local dimming in a state where the block is positioned in the middle of the analysis area, where P indicates the number of blocks and is an odd number equal to or greater than 3. The amount of light in the dimming is determined by the dimming values of the blocks positioned inside the analysis area.

The local dimming control method calculates a pixel gain value of each pixel based on the amount of light in the non-dimming and the amount of light in the dimming in step S15. The local dimming control method multiplies the input data RGB by the pixel gain value to modulate the input data RGB. Hence, the local dimming control method compensates for the input data RGB in step S16. The pixel gain value may be obtained by dividing the amount of light in the non-dimming by the amount of light in the dimming and performing an exponential operation of 1/γ on the division result.

The local dimming control method analyzes the compensated data corresponding to one frame in the bitmap manner to calculate the grayscale saturation level and generates an estimate value of the grayscale saturation level in step S17. In the bitmap manner, the compensated data corresponding to one frame is sequentially scanned while moving an analysis mask of size k×k from side to side or up and down at an interval of one pixel, where k indicates the number of pixels and is a positive integer. Compensated data of a maximum gray level is substituted by "1", and all of compensated data other than the compensated data of the maximum gray level is substituted by "0". The local dimming control method counts the number of "1". The local dimming control method increases the estimate value of the grayscale saturation level when a count value (i.e., the number of "1") increases and reduces the estimate value of the grayscale saturation level when the count value decreases. The grayscale saturation level when the estimate value is a large value is greater than the grayscale saturation level when the estimate value is a small value.

When the estimate value is greater than a previously determined target value in step S18, the local dimming control method reduces the amount of light in the non-dimming in step S19 and then again performs steps S15 to S18. When the estimate value is less than the previously determined target value in step S20, the local dimming control method increases the amount of light in the non-dimming in step S21 and then again performs steps S15 to S20.

The local dimming control method corrects the pixel gain value through the above feedback process, thereby converging the estimate value to the target value. The target value may be selected as a proper value capable of reducing the grayscale saturation while reducing power consumption. The local dimming control method compensate for the input data RGB using the pixel gain value corrected for allowing the estimate value to be equal to the target value and outputs the final modulation data R'G'B'. Further, the local dimming control method outputs the dimming value of each block determined in step S13 as the final dimming value in step S22.

Figure 8:
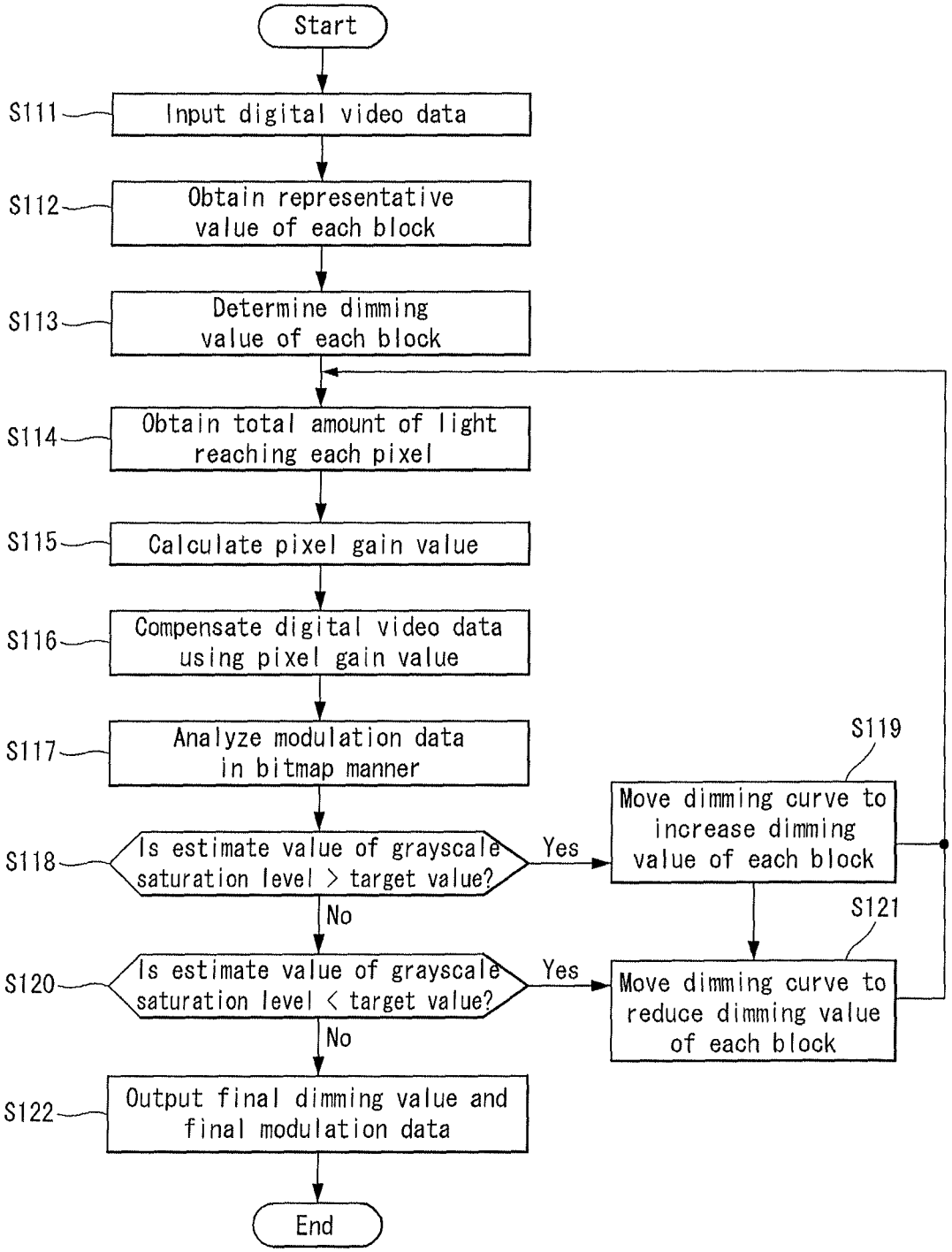
FIG. 8 illustrates another exemplary local dimming control method of a liquid crystal display according to an exemplary embodiment of the invention.

FIG. 8 illustrates another exemplary local dimming control method capable of correcting the pixel gain value based on the grayscale saturation level.

As shown in FIG. 8, the local dimming control method analyzes the input digital video data RGB in each of a plurality of imaginary blocks divided from the display surface of the liquid crystal display panel in a matrix form in step S111 and obtains a representative value of each block in step S112. Then, the local dimming control method maps the representative value of each block to a previously determined dimming curve to determine a dimming value of each block in step S113.

The local dimming control method obtains an amount of light in the non-dimming and an amount of light in the dimming for each pixel in step S114. The amount of light in the non-dimming indicates a total amount of light reaching a corresponding pixel when all of light sources of the backlight unit are turned on at a constant brightness in the non-local dimming. The amount of light in the dimming indicates a total amount of light reaching a corresponding pixel in an analysis area of size P×P surrounding a block including the corresponding pixel in the local dimming in a state where the block is positioned in the middle of the analysis area, where P indicates the number of blocks and is an odd number equal to or greater than 3. The amount of light in the dimming may vary depending on changes in the dimming values of the blocks positioned inside the analysis area.

The local dimming control method calculates a pixel gain value of each pixel based on the amount of light in the non-dimming and the amount of light in the dimming in step S115. The local dimming control method multiplies the input data RGB by the pixel gain value to modulate the input data RGB. Hence, the local dimming control method compensates for the input data RGB in step S116. The pixel gain value may be obtained by dividing the amount of light in the non-dimming by the amount of light in the dimming and performing an exponential operation of 1/γ on the division result.

The local dimming control method analyzes the compensated data corresponding to one frame in the bitmap manner to calculate the grayscale saturation level and generates an estimate value of the grayscale saturation level in step S117. In the bitmap manner, the compensated data corresponding to one frame is sequentially scanned while moving an analysis mask of size k×k from side to side or up and down at an interval of one pixel, where k indicates the number of pixels and is a positive integer. Compensated data of a maximum gray level is substituted by "1", and all of compensated data other than the compensated data of the maximum gray level is substituted by "0". The local dimming control method counts the number of "1" to increase the estimate value of the grayscale saturation level when a count value increases and to decrease the estimate value of the grayscale saturation level when the count value decreases. The grayscale saturation level when the estimate value is a large value is greater than the grayscale saturation level when the estimate value is a small value.

When the estimate value is greater than a previously determined target value in step S118, the local dimming control method moves the dimming curve upward to increase the dimming value of each block in step S119 and then again performs steps S114 to S118. When the estimate value is less than the previously determined target value in step S120, the local dimming control method moves the dimming curve downward to reduce the dimming value of each block in step S121 and then again performs steps S114 to S120. The local dimming control method corrects the pixel gain value through the above feedback process, thereby converging the estimate value to the target value. The target value may be selected as a proper value capable of reducing the grayscale saturation while reducing power consumption.

The local dimming control method compensate for the input data RGB using the corrected pixel gain value obtained when the estimate value is equal to the target value and outputs the final modulation data R'G'B'. Further, the local dimming control method outputs the dimming value of each block adjusted for allowing the estimate value to be equal to the target value as the final dimming value in step S122.

As described above, in the liquid crystal display and the local dimming control method thereof according to the embodiment of the invention, an amount of light in the non-dimming is adjusted based on the grayscale saturation level in the local dimming, or the dimming value of each block is adjusted to automatically correct the pixel gain value. Hence, the image quality of the liquid crystal display can be greatly improved.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A liquid crystal display comprising:

a liquid crystal display panel;

a backlight unit including a plurality of light sources, the backlight unit providing light to the liquid crystal display panel;

a backlight driving circuit that individually drives a plurality of previously determined blocks each including the light sources based on a dimming value of each of the blocks; and a local dimming control circuit that calculates a pixel gain value compensating for a luminance reduction resulting from the dimming value of each block and corrects the pixel gain value based on a grayscale saturation level of each block, wherein the local dimming control circuit adjusts the dimming value of each block and corrects the pixel gain value, and wherein the local dimming control circuit generates an estimate value of the grayscale saturation level and adjusts the dimming value of each block based on the estimate value of the grayscale saturation level.

2. The liquid crystal display of claim 1, wherein the local dimming control circuit includes:

an image analysis unit that analyzes an input data of each block to obtain a representative value of each block;

a dimming value determining unit that maps the representative value of each block to a previously determined dimming curve to determine the dimming value of each block;

a light amount obtaining unit that obtains a first light amount indicating an amount of light reaching each pixel when all of the light sources are turned on at a constant brightness and a second light amount indicating an amount of light reaching each pixel in local dimming using the dimming value of each block;

a gain value calculating unit that calculates the pixel gain value of each pixel based on the first and second light amounts;

a data modulation unit that multiplies the input data by the pixel gain value to compensate for the input data; and a gain value correcting unit that analyzes the compensated input data to generate the estimate value of the grayscale saturation level and adjusts the dimming value of each block based on the estimate value of the grayscale saturation level to perform a feedback process to the light amount obtaining unit.

3. The liquid crystal display of claim 2, wherein the gain value correcting unit moves the dimming curve upward to increase the dimming value of each block when the estimate value is greater than a previously determined target value and moves the dimming curve downward to reduce the dimming value of each block when the estimate value is less than the target value, thereby converging the estimate value to the target value.

4. A local dimming control method of a liquid crystal display including a liquid crystal display panel and a plurality of light sources providing light to a back surface of the liquid crystal display panel, the local dimming control method comprising:

(A) individually driving a plurality of previously determined blocks each including the light sources based on a dimming value of each of the blocks; and (B) calculating a pixel gain value compensating for a luminance reduction resulting from the dimming value of each block and correcting the pixel gain value based on a grayscale saturation level of each block; and wherein (B) comprises:

(B1) analyzing an input data of each block to obtain a representative value of each block;

(B2) mapping the representative value of each block to a previously determined dimming curve to determine the dimming value of each block;

(B3) obtaining a first light amount indicating an amount of light reaching each pixel when all of the light sources are turned on at a constant brightness and a second light amount indicating an amount of light reaching each pixel in local dimming using the dimming value of each block;

(B4) calculating the pixel gain value of each pixel based on the first and second light amounts;

(B5) multiplying the input data by the pixel gain value to compensate for the input data; and (B6) analyzing the compensated input data to generate an estimate value of the grayscale saturation level and adjusting the dimming value of each block based on the estimate value of the grayscale saturation level to perform a feedback process to the step (B3).

5. The local dimming control method of claim 4, wherein (B) comprises:

(B1) analyzing an input data of each block to obtain a representative value of each block;

(B2) mapping the representative value of each block to a previously determined dimming curve to determine the dimming value of each block;

(B3) obtaining a first light amount indicating an amount of light reaching each pixel when all of the light sources are turned on at a constant brightness and a second light amount indicating an amount of light reaching each pixel in local dimming using the dimming value of each block;

(B4) calculating the pixel gain value of each pixel based on the first and second light amounts;

(B5) multiplying the input data by the pixel gain value to compensate for the input data; and analyzing the compensated input data to generate an estimate value of the grayscale saturation level and adjusting the dimming value of each block based on the estimate value of the grayscale saturation level to perform a feedback process to the step (B3).

6. The local dimming control method of claim 5, wherein (B6) comprises moving the dimming curve upward to increase the dimming value of each block when the estimate value is greater than a previously determined target value and moving the dimming curve downward to reduce the dimming value of each block when the estimate value is less than the target value, thereby converging the estimate value to the target value.

* * * * *